US007486156B2

(12) United States Patent
Lee et al.

(10) Patent No.: US 7,486,156 B2
(45) Date of Patent: Feb. 3, 2009

(54) MILLIMETER-WAVE BAND BROADBAND MICROSTRIP-WAVEGUIDE TRANSITION APPARATUS HAVING A MAIN PATCH AND A PARASITIC PATCH ON DIFFERENT DIELECTRIC SUBSTRATES

(75) Inventors: Hong Yeol Lee, Cheongju-si (KR); Dong Suk Jun, Daejeon (KR); Dong Young Kim, Daejeon (KR); Sang Seok Lee, Daejeon (KR); Yong Won Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 241 days.

(21) Appl. No.: 11/486,823

(22) Filed: Jul. 14, 2006

(65) Prior Publication Data

US 2007/0085626 A1 Apr. 19, 2007

(30) Foreign Application Priority Data

Oct. 19, 2005 (KR) ..... 10-2005-0098482

(51) Int. Cl.
*H01P 5/107* (2006.01)

(52) U.S. Cl. ..... 333/26

(58) Field of Classification Search ..... 333/26
See application file for complete search history.

(56) References Cited

U.S. PATENT DOCUMENTS 5,396,202 A * 3/1995 Scheck ..... 333/230
5,539,361 A * 7/1996 Davidovitz ..... 333/26
5,793,263 A 8/1998 Pozar
6,239,669 B1 * 5/2001 Koriyama et al. ..... 333/26
6,580,335 B1 * 6/2003 Iizuka et al. ..... 333/26
6,870,438 B1 * 3/2005 Shino et al. ..... 333/26
2002/0176157 A1 11/2002 Dave et al.
2004/0119564 A1 6/2004 Itoh et al.

FOREIGN PATENT DOCUMENTS

| | | |
|---|---|---|
| EP | 0802578 | 10/1997 |
| JP | 4-109702 | 4/1992 |
| JP | 08-125432 | 5/1996 |
| WO | WO 00/74169 | 12/2000 |

OTHER PUBLICATIONS

'Gap-coupled patch-type waveguide-to-microstrip transition on single-layer dielectric substrate at V-band' Choi et al., Electronic Letters, vol. 40, No. 17, Aug. 19, 2004.

* cited by examiner

*Primary Examiner*—Benny Lee
(74) *Attorney, Agent, or Firm*—Ladas & Parry LLP

(57) ABSTRACT

Provided is a broadband microstrip-waveguide transition apparatus operating in a millimeter waveband. The millimeter-wave band broadband microstrip-waveguide transition apparatus includes a slot for transferring an electromagnetic signal propagating along a microstrip line, a main patch positioned between the slot and a waveguide and resonating from the signal transferred from the slot, and a parasitic patch positioned between the main patch and the waveguide and resonating together with the main patch. According to the millimeter-wave band broadband microstrip-waveguide transition apparatus, it is possible to transfer a signal from the microstrip line to the waveguide, and to increase a resonance bandwidth to a broadband level.

8 Claims, 6 Drawing Sheets

MILLIMETER-WAVE BAND BROADBAND MICROSTRIP-WAVEGUIDE TRANSITION APPARATUS HAVING A MAIN PATCH AND A PARASITIC PATCH ON DIFFERENT DIELECTRIC SUBSTRATES

CROSS-REFERENCE TO RELATED APPLICATION

This application claims priority to and the benefit of Korean Patent Application No. 2005-98482, filed Oct. 19, 2005, the disclosure of which is incorporated herein by reference in its entirety.

BACKGROUND

1. Field of the Invention

The present invention relates to a broadband microstrip-waveguide transition apparatus having a broadband characteristic and operating in a millimeter waveband.

2. Discussion of Related Art

The ongoing development of high-speed, high-capacity wireless communication technology has driven up the operating frequency of wireless communication devices and the like to several tens of GHz and above, which corresponds to the millimeter wavelength region. In addition, the use environment is defined using the concept of a pico cell, which is a wireless communication system covering a small area, (that is, a short-range environment). In such an environment, a horn antenna, which has a higher antenna gain than a planar antenna when absorption in the atmosphere is taken into consideration, is mainly used at the outside of a transceiver module. Therefore, a microstrip-waveguide transition apparatus is required in order to transfer a signal from a radio frequency (RF) stage, in which the signal is transmitted in a plane such as a microstrip line, to a waveguide horn antenna.

According to research conducted thus far, an available frequency band of a transition apparatus that can be used in a frequency band of 60 GHz and above has a narrowband characteristic.

FIG. 1 is an exploded perspective view of a conventional microstrip-waveguide transition apparatus operating in a frequency band of several tens of GHz and above. As shown in FIG. 1, a conventional microstrip-waveguide transition apparatus 10 comprises a microstrip line assembly 12, a waveguide 14, and a ground plate 50 positioned between the microstrip line assembly 12 and the waveguide 14 and having an opening 52. The microstrip line assembly 12 includes a microstrip line 16 and a patch antenna 20. The microstrip line 16 includes a conductive ground plane 18 having a slot 22, a dielectric substrate 32 laminated on the conductive ground plane 18, and a strip conductor 30 that is positioned on the dielectric substrate 32. A portion 40 of the strip conductor 30 crosses the major axis of the slot 22 at a right angle. The patch antenna 20 includes a dielectric layer 34 and a conductor 38.

The conventional microstrip-waveguide transition apparatus 10 is formed so that the slot 22 perpendicular to the middle portion 40 of the strip conductor 30 and extending in the major axis direction is formed on the ground plane 18 of the microstrip line 16 to transfer a signal. The conductor 38 is formed on a lower surface of the dielectric layer 34 so that when the single patch antenna 20 resonates from the transferred signal the transferred signal propagates through the rectangular waveguide 14. However, since the conventional art uses a single patch antenna, it has a narrow resonance band characteristic, and thus is not appropriate for broadband communication.

In another conventional method, a microstrip line traverses a dielectric substrate without a slot, transfers a signal to a main patch antenna and a parasitic patch antenna both existing under the substrate, and propagates the transferred signal to a waveguide. However, since the main patch antenna and the parasitic patch antenna are formed on the same plane, this structure has a narrow resonance band characteristic.

Therefore, in order to widen the resonance band and enable use in broadband communication, a millimeter-wave band microstrip-waveguide transition apparatus having a new structure is required.

SUMMARY OF THE INVENTION

The present invention is directed to a microstrip-waveguide transition apparatus that transfers a signal propagating to a final radio frequency (RF) stage of a millimeter-wave band transceiver module to a waveguide-shaped antenna like a horn antenna and has a broadband characteristic.

In other words, the present invention is directed to a millimeter-wave band broadband microstrip-waveguide transition apparatus that can obtain superior characteristics with the simplicity of its constitution.

One aspect of the present invention provides a millimeter-wave band broadband microstrip-waveguide transition apparatus comprising a slot for transferring an electromagnetic signal propagating along a microstrip line; a main patch positioned between the slot and a waveguide and resonating from the signal transferred from the slot; and a parasitic patch positioned between the main patch and the waveguide and resonating together with the main patch.

The millimeter-wave band broadband microstrip-waveguide transition apparatus may further comprise an open stub for input-impedance matching of the microstrip line.

In addition, the millimeter-wave band broadband microstrip-waveguide transition apparatus may further comprise via holes for electrical conduction between a ground plane of the microstrip line and the waveguide.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF EXEMPLARY EMBODIMENTS

Figure 1:
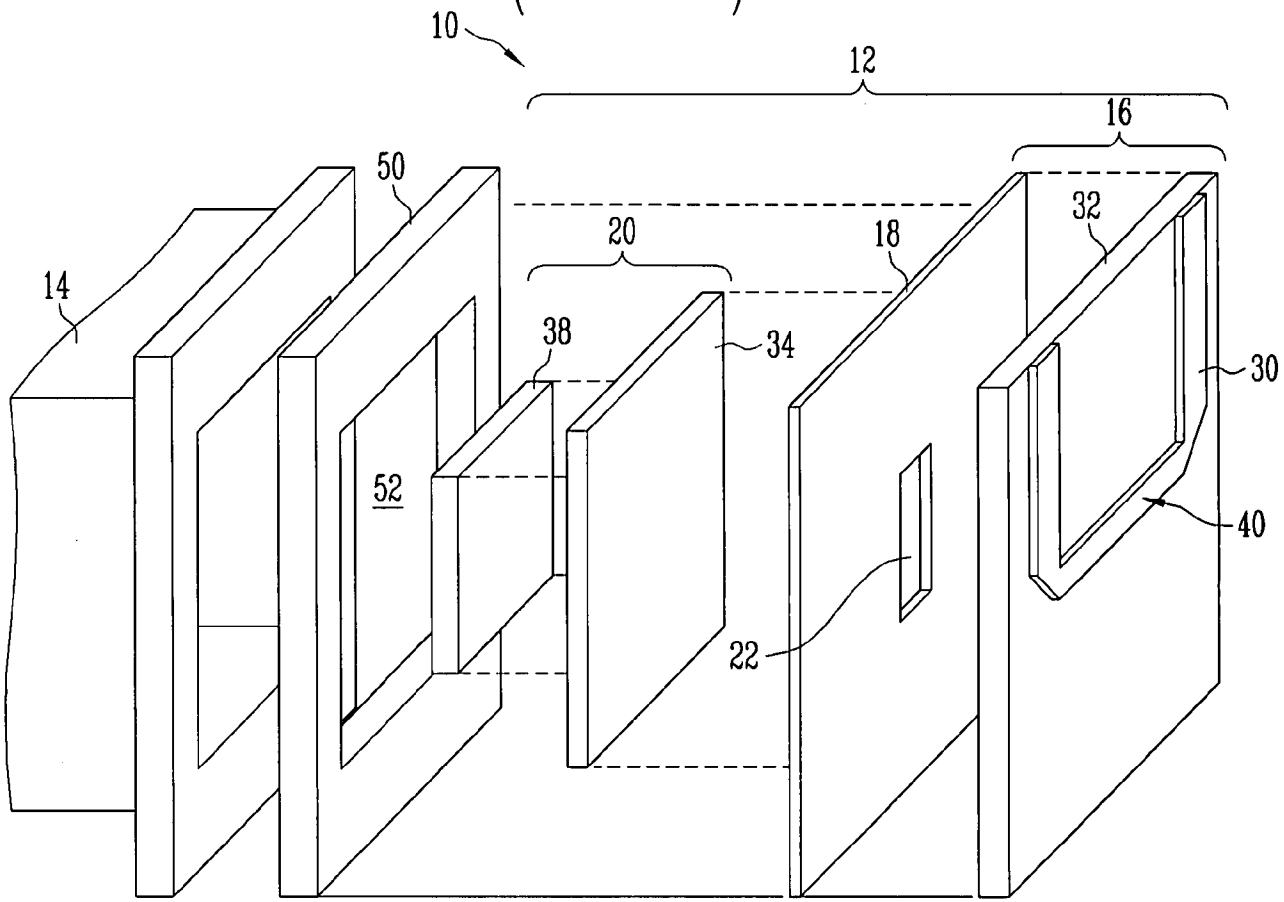
FIG. 1 (PRIOR ART)
FIG. 1 is an exploded perspective view of a conventional microstrip-waveguide transition apparatus.

Hereinafter, an exemplary embodiment of the present invention will be described in detail. However, the present invention is not limited to the embodiments disclosed below, but can be implemented in various types. Therefore, the present embodiment is provided for complete disclosure of the present invention and to fully inform the scope of the present invention to those ordinarily skilled in the art. Like elements are denoted by like reference numerals throughout the drawings.

Figure 2:
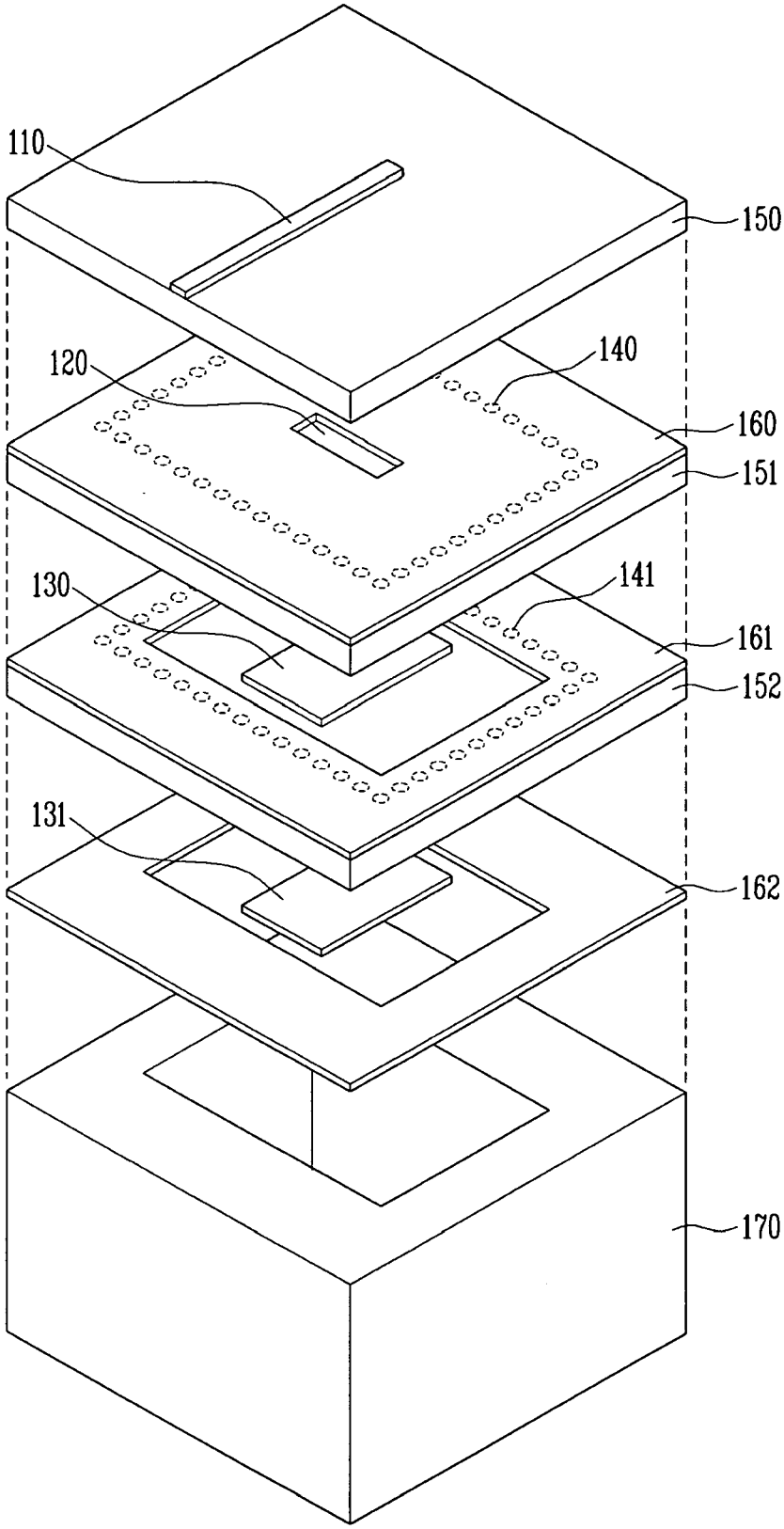
FIG. 2 is an exploded perspective view of a millimeter-wave band broadband microstrip-waveguide transition apparatus according to an exemplary embodiment of the present invention.

FIG. 2 is an exploded perspective view of a millimeter-wave band broadband microstrip-waveguide transition apparatus according to an exemplary embodiment of the present invention.

Referring to FIG. 2, the millimeter-wave band broadband microstrip-waveguide transition apparatus comprises first, second and third dielectric substrates 150, 151 and 152 formed into a triple layer. A microstrip line 110 is formed on a surface of the uppermost layer, i.e., the first dielectric substrate 150.

On a surface of the middle layer, i.e., the second dielectric substrate 151, a first ground plane 160 is positioned. In the first ground plane 160, a slot 120 for transferring a signal propagating along the microstrip line 110 is positioned. In addition, first via holes 140 for electrically connecting a second ground plane 161 on an upper surface of the lowermost layer, i.e., the third dielectric substrate 152, to the first ground plane 160 are positioned in the second dielectric substrate 151.

The second ground plane 161 and a main patch 130 are positioned on the upper surface of the third dielectric substrate 152. The main patch 130 is positioned in the center of an opening in the second ground plane 161 such that the surfaces of the main patch 130 are positioned at a distance from the second ground plane 161. Second via holes 141 for electrically connecting the second ground plane 161 on the upper surface of the third dielectric substrate 152 to a third ground plane 162 on a lower surface of the third dielectric substrate 152 are positioned in the third dielectric substrate 152. The third ground plane 162 and a parasitic patch 131 are positioned on the lower surface of the third dielectric substrate 152. The parasitic patch 131 is in the center of an opening in the third ground plane 162 such that the surfaces of the parasitic patch 131 are positioned at a distance from the third ground plane 162.

In the above construction, a signal propagating along the microstrip line 110 is transferred by the slot 120, and the transferred signal causes the main patch 130 to resonate. Similar to the main patch 130, the parasitic patch 131 is caused to resonate by the signal transferred through the slot 120. A resonant signal of the main patch 130 and the parasitic patch 131 propagates through a waveguide 170.

Figure 3:
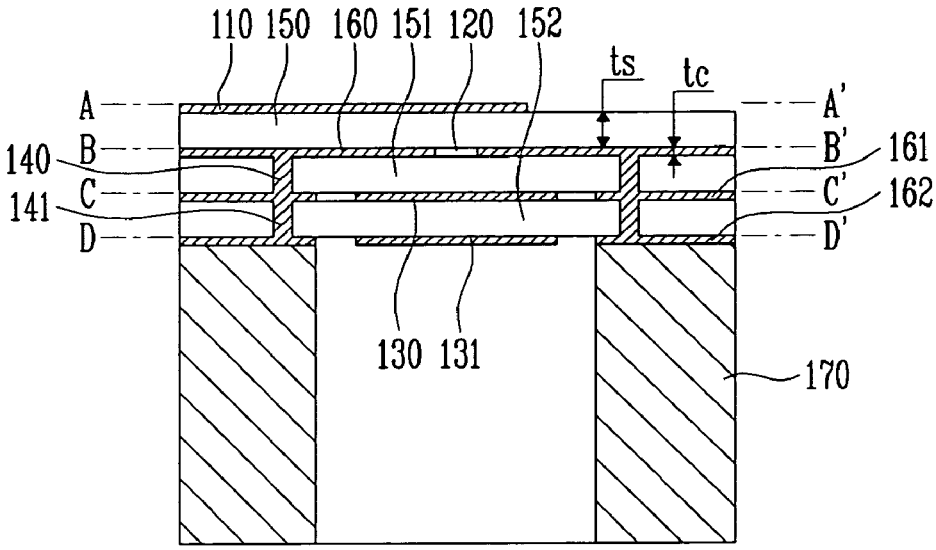
FIG. 3 is a cross-sectional view of the microstrip-waveguide transition apparatus of FIG. 2.

FIG. 3 is a cross-sectional view of the microstrip-waveguide transition apparatus of FIG. 2.

Referring to FIG. 3, the microstrip-waveguide transition apparatus has a structure in which the three dielectric substrates 150, 151 and 152 are laminated on the waveguide 170 operating in a millimeter waveband. In this structure, a radio frequency (RF) signal propagates to the microstrip line 110, is transferred through the slot 120, and causes the main patch 130 and the parasitic patch 131 to resonate, thereby propagating to the waveguide 170. Conversely, an RF signal input to the waveguide 170 causes the parasitic patch 131 and the main patch 130 to resonate, and the resonant signal is transferred through the slot 120 and propagates to the microstrip line 110.

The ground planes 160, 161 and 162 in their respective layers are connected through the via holes 140 and 141 for electrical conduction with the waveguide 170. In addition, the via holes 140 and 141 serve to prevent a signal from leaking into the dielectric substrates 150, 151 and 152. The thickness of the dielectric substrates 150, 151 and 152 is ts, and the thickness of conductors for the microstrip line 110, ground planes 160, 161 and 162, the main patch 130, and the parasitic patch 131 is tc.

In this embodiment, the thicknesses of the three dielectric substrates 150, 151 and 152 are identical for convenience during fabrication, however the present invention is not limited to such a construction. More specifically, the dielectric substrates may be formed of the same or different dielectric material and/or to a different thickness, and the present invention adjusts the characteristic impedance of the microstrip line by changing the width of the microstrip line even when an effective dielectric permittivity varies according to distance between the ground plane and the microstrip line, thereby easily obtaining a desired millimeter-wave band broadband microstrip-waveguide transition apparatus.

FIGS. 4A to 4D are plan views of respective layers of the microstrip-waveguide transition apparatus shown in FIG. 3.

Figure 4A:
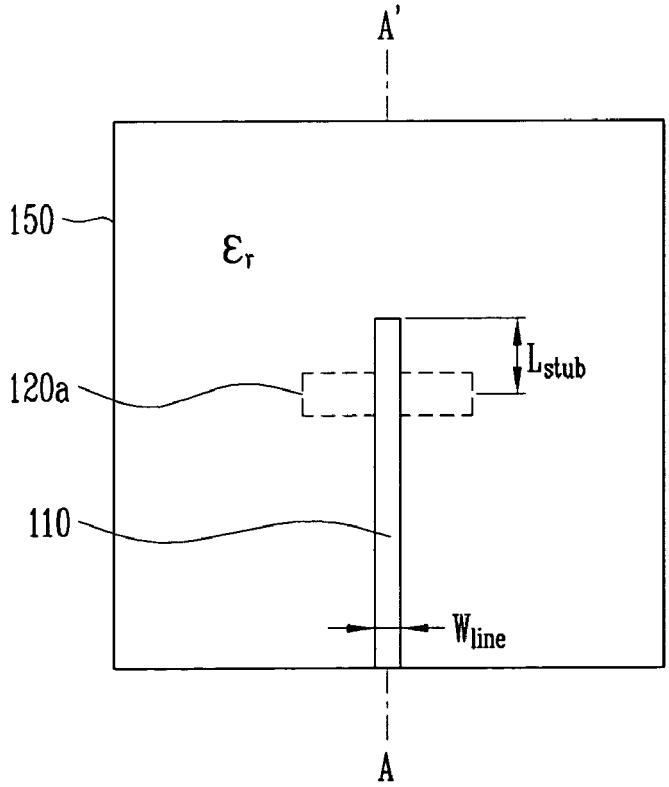
FIGS. 4A to 4D are plan views of respective layers of the microstrip-waveguide transition apparatus shown in FIG. 3.

FIG. 4A is a plan view of the first dielectric substrate taken along a plane A-A' of FIG. 3. As shown in FIG. 4A, in the microstrip-waveguide transition apparatus, the microstrip line 110 is positioned on the first dielectric substrate 150 having a predetermined relative dielectric permittivity $\epsilon_r$. The width of the microstrip line is $W_{line}$, and a distance from the middle of the width of a slot 120*a* disposed on the same plane as the first ground plane of the second dielectric substrate under the first dielectric substrate to the vertical end of the microstrip line 110 is $L_{stub}$. This distance corresponds to an open stub for input impedance matching of the microstrip line 110.

The microstrip line 110 crosses the slot 120*a* in a minor axis direction of the rectangular waveguide 170 (FIG. 3) having a rectangular structure, in order to efficiently combine an electric field generated in the minor axis direction of the rectangular waveguide 170 and a magnetic field generated in a major axis direction of the rectangular waveguide 170.

Figure 4B:
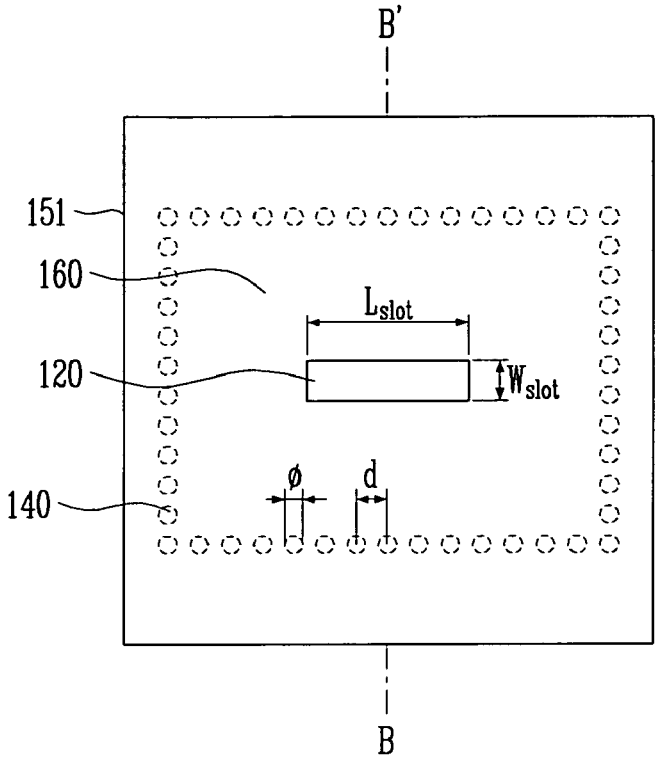

FIG. 4B is a plan view of the second dielectric substrate taken along a plane B-B' of FIG. 3. As shown in FIG. 4B, the slot 120 for signal transfer is positioned in the first ground plane 160 of the second dielectric substrate 151. The length and width of the slot 120 are $L_{slot}$ and $W_{slot}$, respectively. In addition, the first via holes 140 electrically connecting the first ground plane 160 to the second ground plane of the third dielectric substrate are positioned in the second dielectric substrate 151. The diameter of the first via holes 140 is Ø, and the distance between the centers of the via holes 140 is d.

Figure 4C:
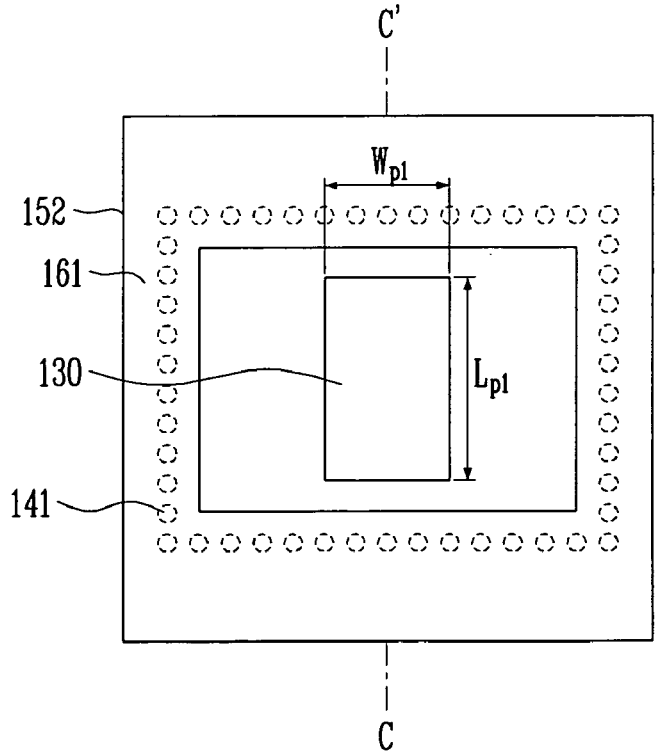

FIG. 4C is a plan view of the third dielectric substrate taken along a plane C-C' of FIG. 3. As shown in FIG. 4C, the second ground plane 161 and the main patch 130 are positioned on the third dielectric substrate 152. In addition, the second via holes 141 electrically connecting the second ground plane 161 to the third ground plane 162 (FIG. 3) positioned on the lower surface of the third dielectric substrate 152 are positioned in the third dielectric substrate 152. The length and width of the main patch 130 are $L_{p1}$ and $W_{p1}$, respectively.

Preferably, the first and second via holes 140 and 141 described above may be formed of a conductive material into a cylinder shape in order to properly prevent a signal from leaking into the dielectric substrates in addition to electrically connecting the ground planes. The diameter Ø of the first and second via holes 140 and 141 may be less than 0.1 mm, and the distance d between adjacent via holes may be less than 0.3 mm. In addition, it is more preferable that the distance between the centers of the via holes is three times the via hole diameter in order to prevent signal leakage.

Figure 4D:
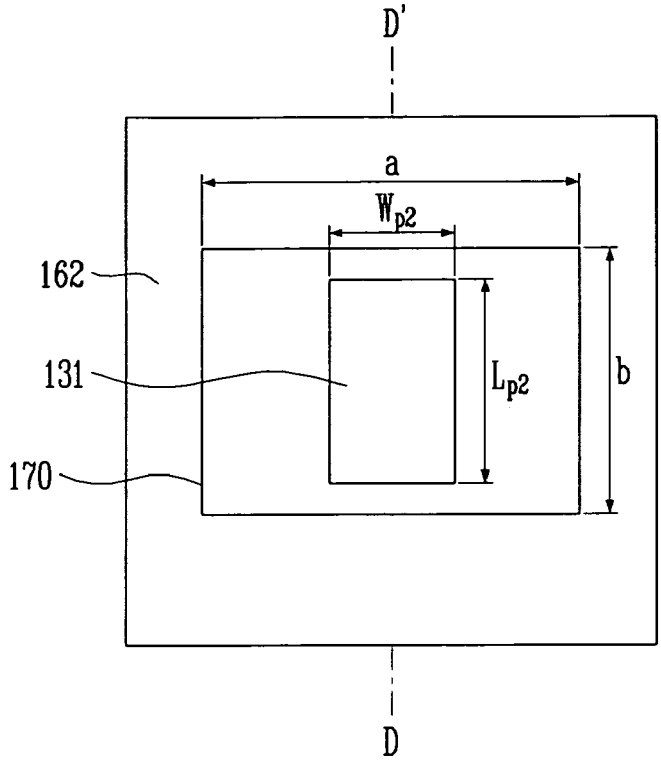

FIG. 4D is a plan view of the waveguide taken along a plane D-D' of FIG. 3. As shown in FIG. 4D, the third ground plane 162 is positioned on an edge of the waveguide 170, and the parasitic patch 131 is positioned in the center of the waveguide 170. The waveguide 170 is formed of a material such as aluminum and has a rectangular structure. A major axis length of the waveguide 170 is a, and a minor axis length is b. The length and width of the parasitic patch 131 are $L_{p2}$ and $W_{p2}$, respectively.

Figure 5:
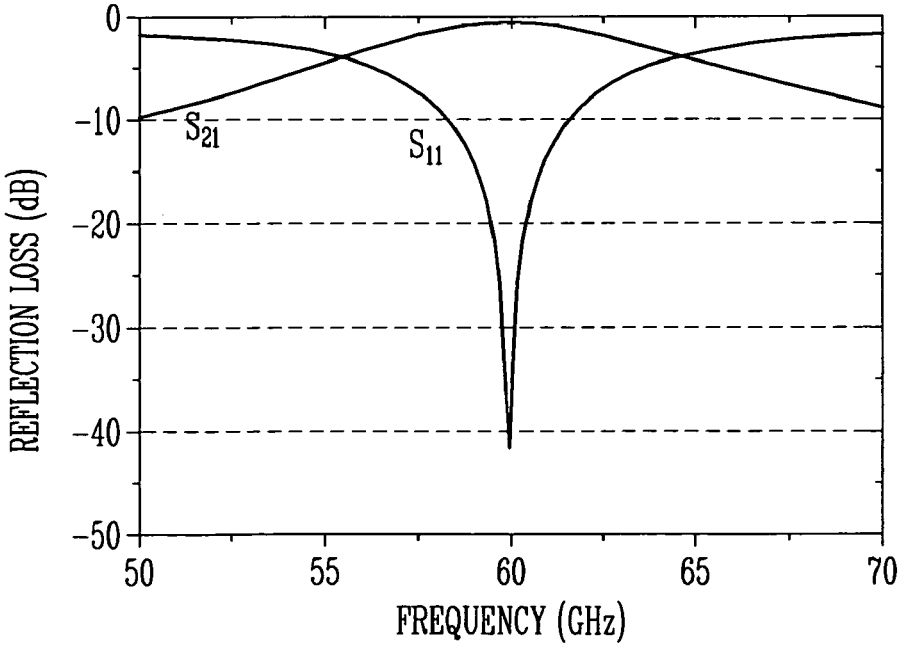
FIG. 5 is a graph showing a frequency response characteristic according to a computer simulation of the microstrip-waveguide transition apparatus shown in FIG. 2 in which there is no parasitic patch.

FIG. 5 is a graph showing a frequency response characteristic according to a computer simulation of the microstrip-waveguide transition apparatus shown in FIG. 2 in which there is no parasitic patch. In FIG. 5, S21 represents a transmission characteristic in dB vs. Frequency in GHz.

As can be seen from FIG. 5, in the microstrip-waveguide transition apparatus according to a comparative embodiment, a frequency response characteristic according to a reflection loss S11 in dB vs. frequency in GHz showed a bandwidth of 5% at a mean frequency of 60 GHz when the reflection loss was −10 dB, and showed a bandwidth of 3% when the reflection loss was −15 dB. Thus, it can be seen that impedance bandwidth was narrow.

The width $W_{line}$ of a microstrip line used in the simulation was 0.28 mm, the length $L_{stub}$ of a stub was 0.5 mm, the length $L_{slot}$ of a slot was 0.55 mm, the width $W_{slot}$ of the slot was 0.5 mm, the diameter Ø of a via hole was 0.085 mm, the distance d between via holes was 0.24 mm, the length $L_{p1}$ of a main patch was 0.825 mm, the width $W_{p1}$ of the main patch was 0.9 mm, the major axis length a of a waveguide was 3.8 mm, the minor axis length b of the waveguide was 1.9 mm, the relative dielectric permittivity $\epsilon_r$ of a dielectric substrate was 5.8, the thickness ts of the dielectric substrate was 0.2 mm, and the thickness tc of a conductor was 0.01 mm.

Figure 6:
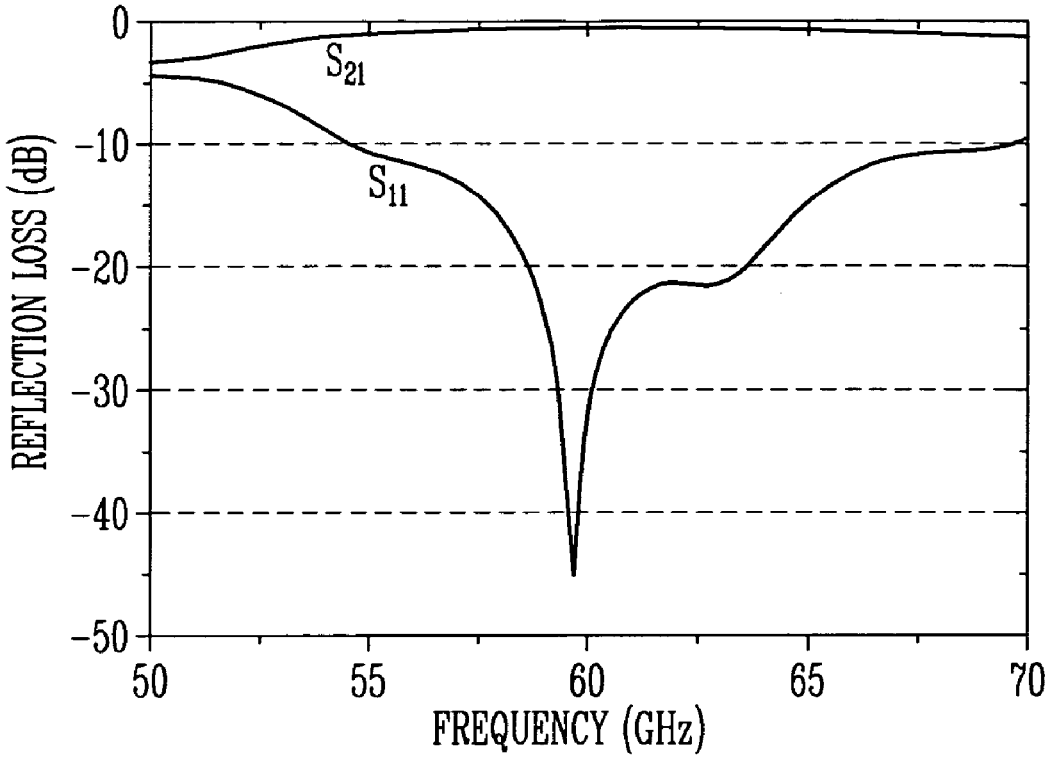
FIG. 6 is a graph showing a frequency response characteristic according to a computer simulation of the microstrip-waveguide transition apparatus shown in FIG. 2 in which a parasitic patch is included.

FIG. 6 is a graph showing a frequency response characteristic according to a computer simulation of the microstrip-waveguide transition apparatus shown in FIG. 2 in which a parasitic patch is included. In FIG. 6, S21 represents a transmission characteristic in dB vs. Frequency in GHz.

As can be seen from FIG. 6, in the microstrip-waveguide transition apparatus according to the exemplary embodiment of the present invention, a frequency response characteristic according to a reflection loss S11 in dB vs frequency in GHz showed a bandwidth of 25% at a mean frequency of 60 GHz when the reflection loss was −10 dB, and showed a bandwidth of 12% when the reflection loss was −15 dB. Thus, it can be seen that the impedance bandwidth was wider than the case where only a single patch was used.

The width $W_{line}$ of a microstrip line used in the simulation was 0.28 mm, the length $L_{stub}$ of a stub was 0.54 mm, the length $L_{slot}$ of a slot was 0.815 mm, the width $W_{slot}$ of the slot was 0.2 mm, the diameter Ø of a via hole was 0.085 mm, the distance d between via holes was 0.24 mm, the length $L_{p1}$ of a main patch was 0.58 mm, the width $W_{p1}$ of the main patch was 0.9 mm, the length $L_{p2}$ of a parasitic patch was 0.54 mm, the width $W_{p2}$ of the parasitic patch was 0.9 mm, the major axis length a of a waveguide was 3.8 mm, the minor axis length b of the waveguide was 1.9 mm, the relative dielectric permittivity $\epsilon_r$ of a dielectric substrate was 5.8, the thickness ts of the dielectric substrate was 0.2 mm, and the thickness tc of a conductor was 0.01 mm.

The present invention has the advantage of increasing the bandwidth of a microstrip-waveguide transition apparatus used in a millimeter waveband to a broadband level.

Meanwhile, since the millimeter-wave band microstrip-waveguide transition apparatus described above can be fabricated by various methods, a description of its fabrication method is omitted. However, when the described transition apparatus is fabricated by a low temperature co-fired ceramic (LTCC) manufacturing process, it can be fabricated by only one process. It is preferable to use a material such as gold or conductive paste for the conductor of the described transition apparatus.

According to the present invention, it is possible to increase a bandwidth of a microstrip-waveguide transition apparatus operating in a millimeter waveband to a broadband level. In addition, it is possible to provide a broadband microstrip-waveguide transition apparatus that can obtain superior characteristics compared to the simplicity of its constitution.

While the invention has been shown and described with reference to certain exemplary embodiments thereof, it will be understood by those skilled in the art that various changes in details such as length, width, thickness, and shape of a microstrip line, slot, dielectric substrate, main patch, parasitic patch, and waveguide may be made therein without departing from the spirit and scope of the invention as defined by the appended claims.

What is claimed is:

1. A millimeter-wave band broadband microstrip-waveguide transition apparatus comprising:

a slot for transferring an electromagnetic signal propagating along a microstrip line;

a main patch positioned between the slot and a waveguide and resonating in response to the signal transferred from the slot; and a parasitic patch positioned between the main patch and the waveguide and resonating together with the main patch;

a first dielectric substrate, a second dielectric substrate, and a third dielectric substrate respectively positioned between the microstrip line and the slot, between the slot and the main patch, and between the main patch and the parasitic patch.

2. The millimeter-wave band broadband microstrip-waveguide transition apparatus of claim 1, further comprising an open stub for input impedance matching of the microstrip line.

3. The millimeter-wave band broadband microstrip-waveguide transition apparatus of claim 2, wherein the open stub has a length extending from the middle of the width of the slot to an end of the microstrip line.

4. The millimeter-wave band broadband microstrip-waveguide transition apparatus of claim 1, further comprising via holes for electrical conduction between a ground plane of the microstrip line and the waveguide.

5. The millimeter-wave band broadband microstrip-waveguide transition apparatus of claim 4, wherein the via holes are of a cylindrically shaped conductive material, and have a diameter of less than 0.1 mm, and are at a distance of less than 0.3 mm from each other.

6. The millimeter-wave band broadband microstrip-waveguide transition apparatus of claim 4, wherein centers of the via holes are spaced from each other by a distance which is three times a diameter of the via holes.

7. The millimeter-wave band broadband microstrip-waveguide transition apparatus of claim 4, wherein the via holes are positioned in the second dielectric substrate positioned between the slot and the main patch and in the third dielectric substrate positioned between the main patch and the parasitic patch.

8. The millimeter-wave band broadband microstrip-waveguide transition apparatus of claim 1, wherein the waveguide has a rectangular structure, and the microstrip line crosses the waveguide in a short axis direction of the waveguide positioned under the microstrip line.

* * * * *